US005798922A

United States Patent [19]

Wood et al.

[11] Patent Number: 5,798,922

[45] Date of Patent: Aug. 25, 1998

[54] METHOD AND APPARATUS FOR ELECTRONICALLY EMBEDDING DIRECTIONAL CUES IN TWO CHANNELS OF SOUND FOR INTERACTIVE APPLICATIONS

[75] Inventors: Paul Nigel Wood, Glendale; Laura Mercs, Huntington Beach; Paul Embree, Irvine, all of Calif.

[73] Assignees: Sony Corporation, Tokyo, Japan; Sony Pictures Entertainment, Inc., Culver City, Calif.

[21] Appl. No.: 788,739

[22] Filed: Jan. 24, 1997

[51] Int. Cl.[6] ..... H04H 5/00

[52] U.S. Cl. ..... 364/400.01; 381/17; 381/18; 381/25; 84/645; 84/662; 369/87

[58] Field of Search ..... 364/400.01; 381/17, 381/18, 25, 12, 80, 89, 97, 102, 104; 84/645, 662, 696, 701; 369/87, 91

[56] References Cited

U.S. PATENT DOCUMENTS

| | | | |
|---|---|---|---|
| 2,846,504 | 8/1958 | Mikulyak | 179/1 |
| 3,088,997 | 5/1963 | Bauer | 179/1 |
| 3,863,028 | 1/1975 | Fixler | 179/1 |
| 3,970,787 | 7/1976 | Searle | 179/1 |
| 4,088,849 | 5/1978 | Usami et al. | 179/156 |
| 4,119,798 | 10/1978 | Iwahara | 179/1 |
| 4,209,665 | 6/1980 | Iwahara | 179/1 |
| 4,218,585 | 8/1980 | Carver | 179/1 |
| 4,251,688 | 2/1981 | Furner | 381/18 |
| 4,308,424 | 12/1981 | Bice | 381/17 |
| 4,589,128 | 5/1986 | Pfleiderer | 381/17 |
| 5,033,086 | 7/1991 | Fidi | 381/25 |
| 5,181,248 | 1/1993 | Inanaga et al. | 381/25 |
| 5,386,082 | 1/1995 | Higashi | 84/630 |
| 5,438,623 | 8/1995 | Begault | 381/17 |
| 5,459,790 | 10/1995 | Scofield et al. | 381/25 |
| 5,661,812 | 8/1997 | Scofield et al. | 381/25 |

FOREIGN PATENT DOCUMENTS

| | | |
|---|---|---|
| 2344259 | 4/1975 | Germany . |
| 1600885 | 10/1981 | United Kingdom . |
| 2224186 | 4/1990 | United Kingdom . |

OTHER PUBLICATIONS

Audio Reality Handout by Crystal River Engineering. No Date—1 Page Document.

*Primary Examiner*—Thomas Peeso

*Attorney, Agent, or Firm*—Blakely, Sokoloff, Taylor & Zafman LLP

[57] ABSTRACT

A system for providing audible cues that enable a listener to identify locations of origins of sounds. In one embodiment, a front and rear signal are copies of an input signal. The rear signal is modified by application of a modified head related transfer function which is the difference between the front and rear head related transfer functions. Copies are then made of the front signal and the modified rear signal, one copy of each associated with a first channel and one copy of each associated with a second channel. Front/rear cues are applied by delaying one of the rear signals or inverting the phase of one of the rear signals. Volume levels are then modified according to the location of the sound source. Locations of sound sources, including sources location behind the user are therefore audibly distinguished. Thus, in an interactive environment, such as a video game environment, the sounds generated by moving objects can be readily modified by simply modifying the volume levels.

40 Claims, 6 Drawing Sheets

| | LEFT FRONT | RIGHT FRONT | LEFT REAR | RIGHT REAR |
|---|---|---|---|---|
| A | 10 | 10 | 0 | 0 |
| C | 0 | 0 | 10 | 10 |
| B | 1 | 5 | 1 | 5 |
| D | 5 | 1 | 5 | 1 |

METHOD AND APPARATUS FOR ELECTRONICALLY EMBEDDING DIRECTIONAL CUES IN TWO CHANNELS OF SOUND FOR INTERACTIVE APPLICATIONS

BACKGROUND OF THE INVENTION

1. Field of the Invention

The present invention relates to the field of generating three dimensional sound through two channels. More particularly, the present invention relates to a method and apparatus for providing two channels of sound in an interactive environment that emulate sound produced from multiple directions.

2. Art Background

Today's video games have become quite sophisticated. The graphics have become quite detailed and animated. However, the sounds generated with the graphics have remained somewhat limited due to the processing power required to provide any level of sophistication in depth. In particular, to further enhance the video game presentation it is desirable to provide directional sound, including sounds that distinguish sound sources behind and in front of the user. For example, if an object generating noise is shown at the far right hand side of the screen, it is desirable that the player of the game audibly determines the location of the object generating the sound.

The technology for generating directional sound through two channels is well known. For example, head related transfer functions (HRTF) are applied to sounds to provide the directional cues needed for a listener to determine audibly the location the sound is coming from. The HRTFs and their application to the sound signals is computationally intensive. Therefore, it is impractical to repeatedly apply HRTFs to sound signals in order to identify the location of origin of those sounds. This is particularly problematic when the object or location generating the sound is in constant motion. Some systems have attempted to overcome these drawbacks by providing limited audible directional cues that are accessed from a memory according to the location the object is on the display. However, this approach often proves to be impractical for the consumer video game market, because it requires too much computer memory and/or too much computer processing time in an environment where computer power (i.e., usage of memory and processing speed) is extremely valuable. In a highly competitive market, each processor cycle and each memory byte must justify its value or be used for some other game feature which brings more value to game play. Any sound system that wishes to compete in such a market must be highly efficient in its use of computer power, i.e., usage of memory and processing speed.

SUMMARY OF THE INVENTION

It is therefore an object of the present invention to provide three dimensional sound in an interactive environment.

A system and method is described for providing three dimensional directional sound cues through two channels. The process employed requires minimal processor overhead at the time of reproduction; this enables utilization in a highly interactive environment such as a video games, as objects that generate sound or perceived origins of sound move about the display and the directional sound cues generated for the associated sounds similarly change.

Preprocessing is performed on a front and rear signal. The rear signal is a copy of the front signal modified by application of the difference of head related transfer functions (HRTF) between the front and the rear locations. In an alternate embodiment, a 90° phase shift relative the front signal is also applied to the rear signal. Preferably, the front signal is delayed by the same amount as the processing delay of the rear signal such that the front and rear signals are output at approximately the same time. The front signal and the rear signal as modified are stored on a storage device such as a CD ROM of the video game. During play of the video game, the front and rear signals are accessed. Copies are made of both signals and one copy is associated with the left channel and one is associated with the right channel. A phase disturbance is applied between the rear signals to further provide the sound cues to further distinguish between the front and the rear locations. Based upon the location of the object that makes the sound, the volume of the left and right front signals and the left and right rear signals are modified to provide additional necessary interactive directional cues to audibly distinguish the location of the object. The left signals and the right signals are then combined for output as two channels; the channels are directed to a two speaker system such as stereo headphones. The resultant two channels of combined signals provide the user the audible cues needed to determine the locations of origins of sounds.

BRIEF DESCRIPTION OF THE DRAWINGS

The present invention is illustrated by way of example, and not by way of limitation, in the figures of the accompanying drawings, and in which like reference numerals refer to similar elements, and in which.

DETAILED DESCRIPTION

In the following description, for purposes of explanation, numerous details are set forth in order to provide a thorough understanding of the present invention. However, it will be apparent to one skilled in the art that these specific details are not required in order to practice the present invention. In other instances, well known electrical structures and circuits are shown in block diagram form in order not to obscure the present invention unnecessarily.

The method and apparatus of the present invention is a simple but effective mechanism for providing three dimensional directional sound cues with minimal processor overhead. As minimal overhead is incurred, the process easily lends itself to applications in lower power processor environments. This invention is readily applicable to the video game system environment; however, it is contemplated that the present invention is not limited to the video game environment. For example, the present invention may be applied to sound recordings or sound recordings associated with non-game video, such as a movie. In such situations, the interactive process may be applied to the movement of the user.

Figure 1:
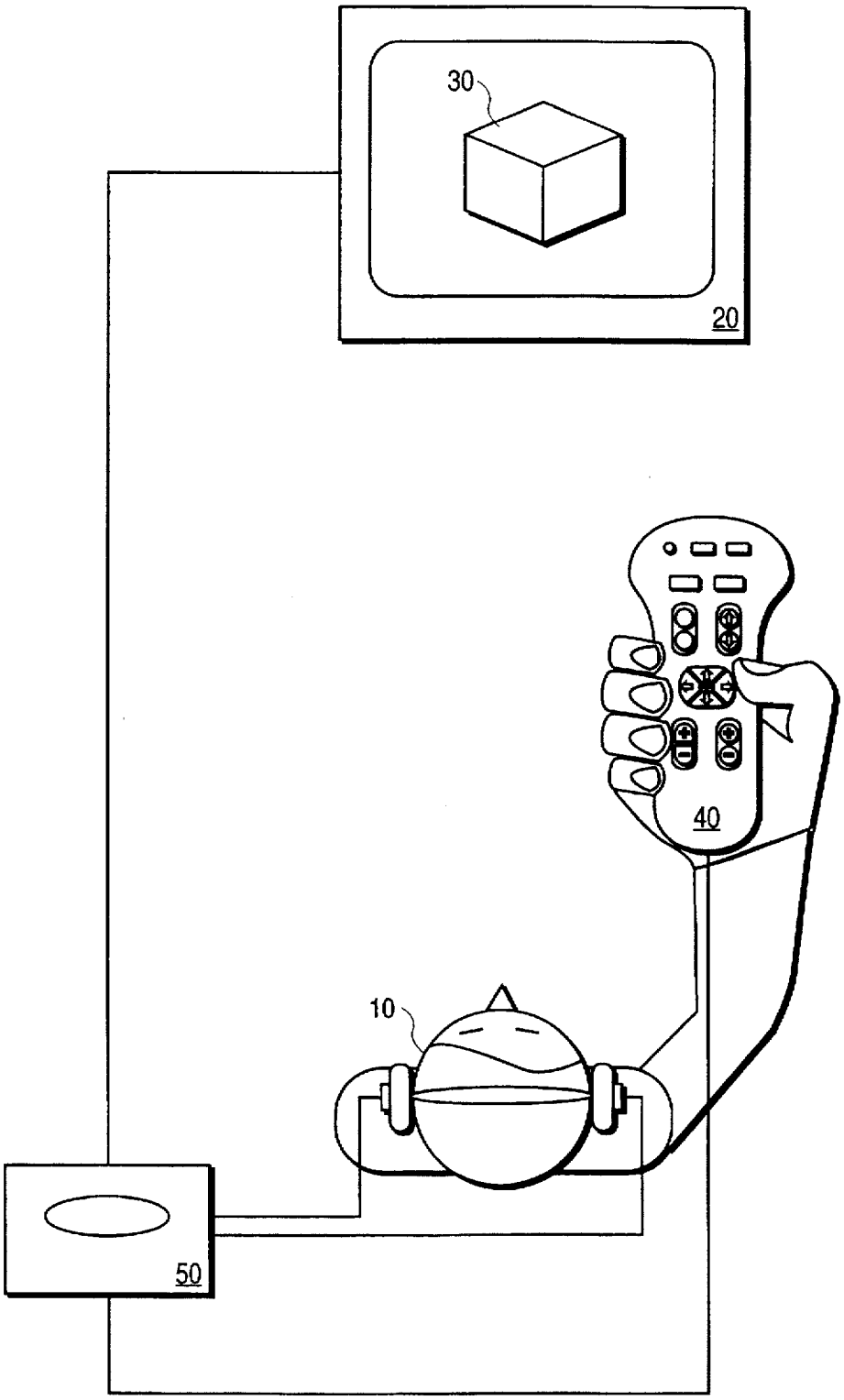
FIG. 1 provides an illustrative system which operates in accordance with the teachings of the present invention.

An illustrative system is shown in FIG. 1. A user or player 10 sits in front of the display 20 and manipulates objects 30 on the display 20 using a controller 40. The game controller 50 controls the display to move the objects or the user in the display space of the game in accordance with the signals generated by the controller 40. In one embodiment where the sound is associated with a visible object, the game controller 50 also generates the associated audible directional cues such that the user not only sees the object 30 moving but audibly perceives the movement of the object. Objects or the user can be moved about the user or an object in a 360° rotation using the techniques described herein. Similarly, sounds having a place of origin but not associated with objects, or associated with an exemplary object not shown on the display (e.g., an object located behind the user) can be manipulated to provide audible directional cues.

Figure 2A:
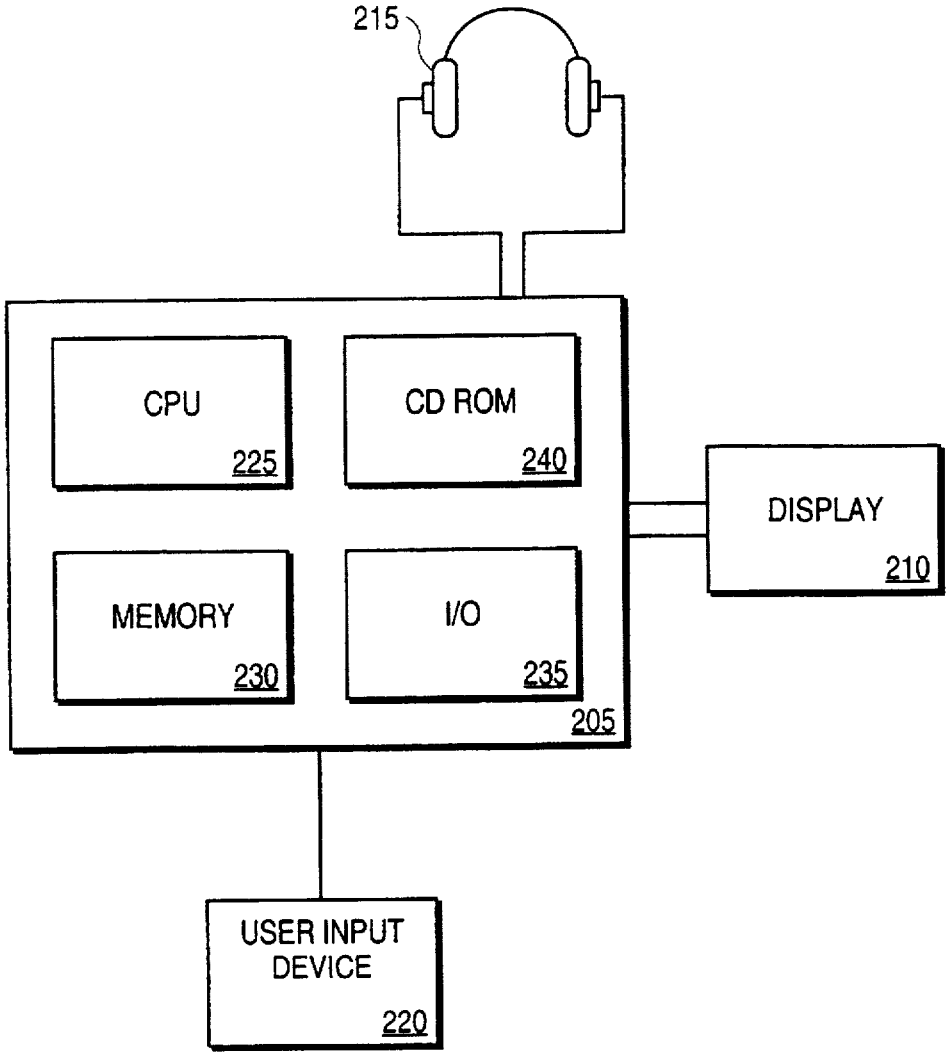
FIG. 2*a* and FIG. 2*b* are block diagram illustrations of exemplary systems which operate in accordance with the teachings of the present invention.
Figure 2B:
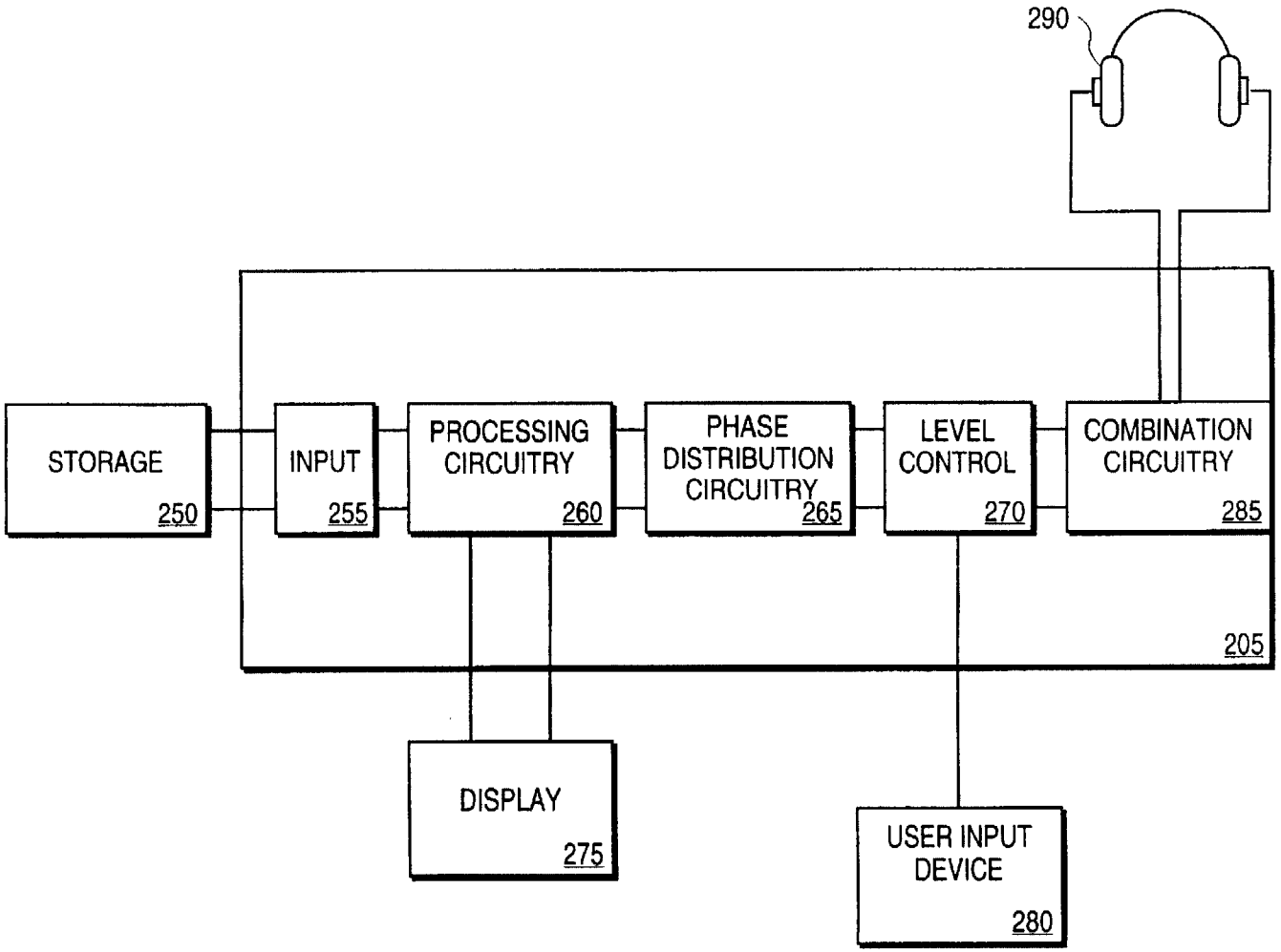

Block diagrams of one embodiment of the system are shown in FIGS. 2*a* and 2*b*. The system includes the processor subsystem 205, display 210, output speakers, in this situation headphones 215, and a user input device 220. The processor subsystem includes a CPU 225, memory 230, input/output control devices 235, and, in this embodiment, a CD ROM drive 240 which functions as a storage device for the program and data needed to operate the video game. It is readily apparent that the processor subsystem may be implemented using a plurality of logic devices to perform the functions described herein.

The preprocessed audio, as discussed below, is stored on a CD Rom 240, and subsequently loaded into memory 230 for access during program game execution. It should be readily apparent that a variety of storage media, volatile or non-volatile, may be used, such as RAM or digital video disks (DVD). If volatile memory is used, it is preferred that the preprocessed data is downloaded prior to performing the interactive portion of the process.

The user input device 220 is the device manipulated by the user to move objects about the screen or to move the location of an aural object which consists of at least one source of sound. The user input device data is used to manipulate the sound signals to provide the three dimensional audible cues to the user. A variety of devices, e.g. keyboard, joystick, mouse, glove, or head apparatus may be used. The audio output device 215 is shown to be stereo headset; however, it is readily apparent that the output device could also be a pair of speakers or other output devices accepting two channels for output.

An alternate embodiment is shown in FIG. 2*b*. Referring to FIG. 2*b*, the preprocessed sound signals are stored on a storage device 250 such as nonvolatile memory or a CD ROM. The signals are received through the input circuit 255 and processed by processing circuitry 260 to modify the rear signal and provide two copies of each signal, one associated with the right channel and one associated with the left channel. Phase disturbance circuitry 265 provide additional audible cues to distinguish the front/rear locations of sounds by adding a delay or inverting the phase of one of the rear signals. The level control circuit 270 is preferably controlled by the user input device as, in the present embodiments, the position of the user or objects on the display 275 dictates the volume levels modified. It should be readily apparent that volume control circuitry need not be controlled by the user input device; in alternate embodiments, the volume control circuitry can be controlled by pre-programmed controls or other methods. The copies of the front and rear signals are combined into two channels by combination circuitry 285. For example, the first copy of the adjusted front signal is added to the adjusted first copy of the modified rear signal to produce a first channel output and the adjusted second copy of the front channel is added to the adjusted second copy of the modified rear signal to produce a second channel.

FIGS. 2*a* and 2*b* are illustrative of the systems which employ the teachings of the present invention. As is readily apparent, the system can be used in a non-interactive environment wherein the sound directions are identified by locations stored in memory or some other mechanism that does not require user input. Furthermore, the system can be used in a non-video game system to provide enhanced sound quality.

The process for generating the audible cues can be divided into two portions, a preprocessing portion and an interactive portion. As will be apparent to one skilled in the art, it is not necessary to divide the process into two portions; however for minimization of processor overhead at the time of sound reproduction, it is desirable.

Figure 3A:
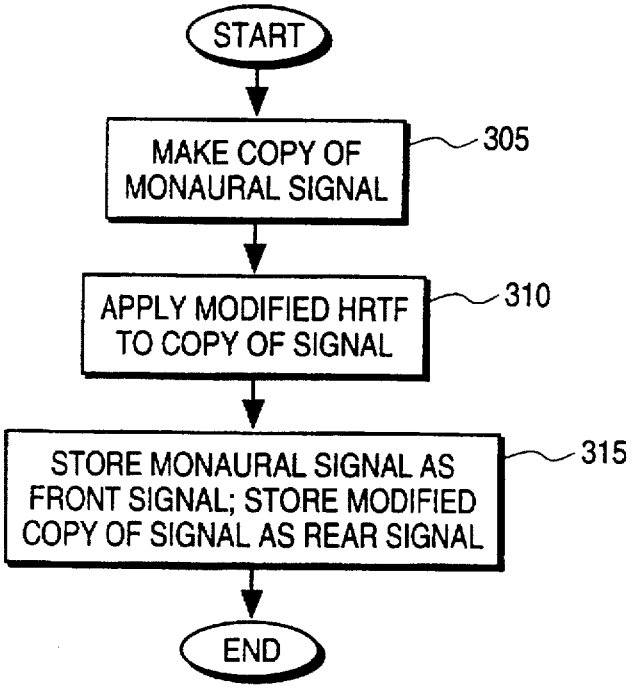
FIG. 3*a* sets forth a simplified flow chart of one embodiment of the preprocessing step performed in accordance with the present invention.

FIG. 3*a* illustrates the preprocessing portion of the process. At step 305, a copy of the input signal is generated. In the present embodiment, a monaural signal is utilized as the input signal. However, the input can include multiple signals. In such an embodiment, it is preferred that multiple devices or processes are used to preprocess the multiple signals.

One copy of the signal is identified as the front signal, and the second is identified as the rear signal. At step 310, the rear signal is modified by applying a modified head related transfer function (HRTF) to the rear signal.

Head related transfer functions (HRTFs) were developed to correspond to spherical directions around the head of the listener. The HRTFs are applied to sound signals to provide audible directional cues in the sound signals. The application of unmodified HRTFs to the surround sound signal provides directional cues in a two channel output at the cost of sound quality. In particular, signals to which the unmodified HRTFs have been applied experience an undesirable amount of spectral boost and attenuation. Typically, the signals generated by such a process produce a low quality signal suitable for bandwidths in the 5 KHz range. Although for voice applications this may be sufficient, it is undesirable when full bandwidth signals are needed, such as signals typically with bandwidths up to the 18 KHz range. Thus for applications such as movie soundtracks and high quality computer generated audio, such spectral boost and attenuation is undesirable.

To overcome this shortcoming, the HRTFs are modified to factor out the frequency response of the HRTF corresponding to one of the front channels. This provides the ability of distinguishing more clearly sounds originating in front of the user from sounds originating from the rear of the user without substantially reducing the final quality of the signal.

In the present embodiment, the modified HRTF signal is the difference between the HRTF of the front position and the HRTF of the rear position. Preferably, the modified HRTF is determined by subtracting the HRTF of the front signal from the HRTF of the rear signal (HRTh rear−HRTh front), where HRTF rear is the HRTF which corresponds to the left rear and HRTF front is the HRTF which corresponds to the front center. The modified HRTh can be computed in implementation a variety of ways. For example, the difference between the rear and front HRTF values at each particular frequency (e.g. 1 KHz, 2 KHz, 3 KHz, etc.) specified are determined to compute the modified HRTF.

Obviously other front HRTFs may be used. Alternately, different front HRTFs may be used for different rear signals.

In an alternate embodiment, a 90° phase shift relative to the front signal is also applied to the rear signal. This provides an output that is compatible with three dimensional sound decoders, such as those which drive a multiple speaker surround sound sound system. A variety of implementations can be used. For example, in one embodiment, a Hilbert transform is utilized (see, e.g.) Oppenheim, A. and Schafer, R., *Dicrete Time Signal Processing*, pp. 662–686, (Pretiss-Hall, 1989).

Once the front and rear signals are generated, at step 315, the signals are stored for subsequent access. Thus, the stored front and rear signals can be repeatedly accessed and modified as described below to provide the audible cues for the user to perceive the source of sounds.

Although the present embodiment describes that the preprocessed signals were stored on a media and subsequently accessed when needed, it is apparent to one skilled in the art that the preprocessing and the interactive portion can be performed sequentially without storing the intermediate signals. Alternately, the signals may be temporarily stored in volatile media wherein the preprocessing portion is performed each time the device is powered up.

Figure 3B:
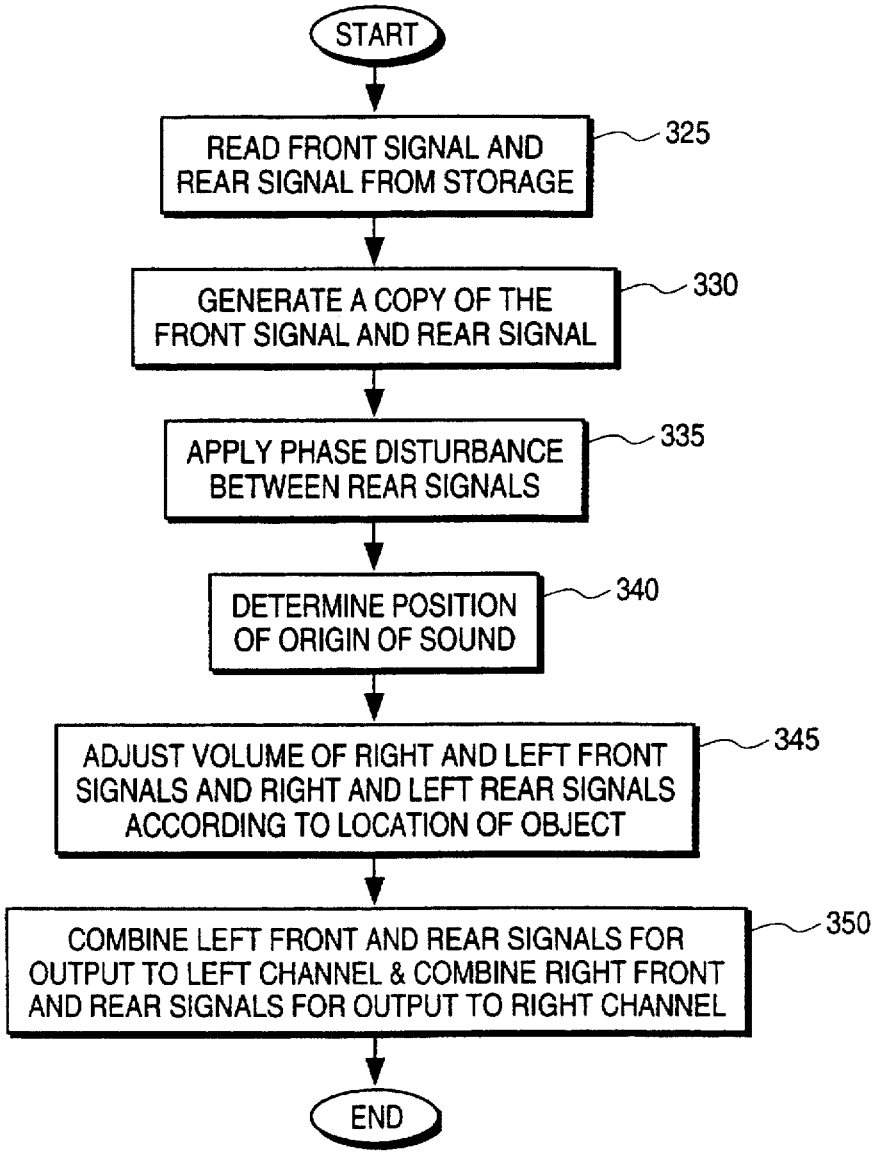
FIG. 3*b* is a simplified flow diagram illustrating the post processing of the audio signal to provide the three dimensional cues in accordance with the teachings of the present invention.

The interactive process is now described with reference to FIG. 3*b*. At step 325, the front and rear signals are retrieved from storage and a copy is made of each, step 330. One copy is associated with the right channel to be generated, and one copy is associated with the left channel. At step 335, a phase disturbance is applied to the rear signals (left and right channels). In one embodiment, this is accomplished by inverting the phase of one of the rear signals. Alternately, the phase disturbance is performed by applying at least one delay to at least one rear signal resulting in one rear signal being delayed relative to the other signal. For example, a 0–3 ms delay may be used. Preferably, a delay is applied to one of the rear signals. However, delays of unequal amounts can be applied to both rear signals to generate a differential delay to gain the same result and provide the additional directional cues with respect to distinguishing between sound originating from the front or the rear.

At step 340, the position of a sound source relative to the user is determined. In one embodiment, an object that generates the sound is located on the display. For example, location data may be provided by the movement of the object by the user manipulating the control device. Alternately, the program executing may indicate a new position of the object based on other parameters.

In another embodiment, movement of the user within the scope of the game space, dictates the changes of relative locations of sound sources. Still, in another embodiment, the sound source may not be associated with an object or a displayed object. One example is a sound source to the rear of the user. Even though the same representation of the sound source is not visible, movement of the source of sound can be performed and perceived audibly by the user. Once the sound source position is determined, the levels of the right and left front signals and the right and left rear signals are adjusted according to the location of the object, step 345. While the level control is very simple to implement and requires little overhead, the left and right level control provide for the front and rear signals the necessary left to right directional cues and also provide the necessary additional front to back directional cues to enable the user to audibly distinguish locations of sound sources that are positioned around the user's head.

At step 350, the left front and left rear signals are combined to generate the left channel, and the right rear and right front signals are combined to generate the right channel. These signals may be output to a two channel system, such as a stereo headset worn by the user. Alternately, the two channels can be combined with other sound signals, such as background sounds for output to the user.

As objects, the user or origins of sound, move, steps 340, 345, 350 are repeatedly performed to modify the audible directional cues to reflect movement of sound sources.

The volume levels of the right and left front and the right and left rear signals are adjusted according to the location of the sound source generating the sound. Thus, for example, if the sound source is located to the front of the user and to the right, the right front signal would carry the loudest sound level, whereas the left rear signal would generate the lowest level.

Preferably, the level settings to distinguish right and left movement are controlled such that the minimum extreme is always a minimum value greater than zero. For example, if the sound source is located to the far right, a minimal level is associated with the left level; the right channel would be set to a maximum level. Preferably, front to back movement can be controlled by level settings such that the minimum extreme can be zero.

Figures 4A, 4B:
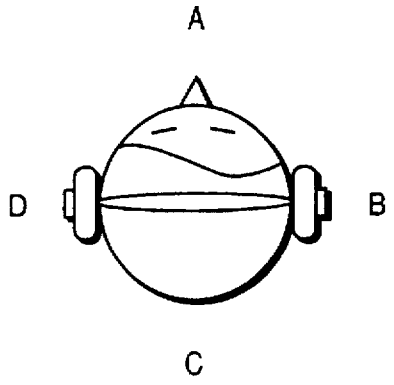
FIG. 4*a* is a table which defines illustrative volume settings to provide the interactive directional cues in accordance with the teachings of the present invention.
FIG. 4*b* illustrates the positions for which directional cues are provided with respect to the table of FIG. 4*a*.

FIGS. 4*a* and 4*b* provide a simplified example of exemplary level controls to provide some directional cues. In this example, 10 is considered to be the absolute maximum and 0 is the absolute minimum. For example, position A, in the front and center with respect to the listener, would provide a level 10 control to the front signals and the two rear signals would simply be at a level 0. As is readily apparent to one skilled in the art, the amount of amplification attenuation associated with each signal is determined according to application. In the example herein, levels are identified by number in order to illustrate the relative differences in volume levels utilized.

Continuing with the examples illustrated in FIGS. 4*a* and 4*b*, if the sound source is located behind the user at location C, the left and right front signals would be at the lowest level, whereas the left and right rear signals would be at the highest level. It follows that if the sound source was located to the right of the user, the strongest signals would be the right front and right rear signals. Similarly, if the signal was originating from the left side, the left front and left rear signals would carry the strongest signal. The spacing between level adjustments located between the minimum and the maximum adjustments can vary according to application. For example, intermediate values may be determined by linearly interpolating between the minimum and maximum. Alternately, non-linear dilineations between the minimum and maximum levels may be applied. Other variations of modifying the signals are contemplated.

The invention has been described in conjunction with the preferred embodiment. It is evident that numerous alternatives, modifications, variations and uses will be apparent to those skilled in the art in light of the foregoing description.

What is claimed is:

1. A method for reproducing from an input signal at least one sound having audible directional cues, a first copy of the input signal being a front signal and a second copy of the input signal being a rear signal, said method comprising the steps of:

associating a first copy of the front signal with a first channel and a second copy of the front signal with a second channel;

associating a first copy of a modified rear signal with a first channel and a second copy of the modified rear signal with a second channel; the modified rear signal generated by applying a modified head related transfer function to the rear signal of the input signal; and selectively adjusting volume levels of the first and second copies of the modified rear signals and the first and second copies of the front signal to provide additional audible directional cues based upon perceived locations of origin of at least one sound.

2. The method as set forth in claim 1, wherein the modified head related transfer function is the difference between a front head related transfer function and a rear head related transfer function.

3. The method as set forth in claim 1, wherein the modified rear related transfer function is HRTFrear–HRTFfront, where HRTFrear is a rear head related transfer function and HRTFfront is a front head related transfer function.

4. The method as set forth in claim 3, wherein HRTFfront is a front center head related transfer function.

5. The method as set forth in claim 3, wherein HRTFrear is a left rear head related transfer function.

6. The method as set forth in claim 1, further comprising the steps of:

storing the modified rear signal and the front signal on a storage media; and subsequently retrieving the modified rear signal and the front signal from the storage media.

7. The method as set forth in claim 1, further comprising the step of applying a phase disturbance between the first and second copies of the modified rear signal to provide direction cues to distinguish sounds originating from the front or rear, wherein the step of selectively adjusting volume levels adjusts the first and second copies of the phase disturbed modified rear signals and the first and second copies of the front signal.

8. The method as set forth in claim 7, wherein the step of applying a phase disturbance comprises adding at least one time delay to at least one of the first and second copies of the modified rear signal.

9. The method as set forth in claim 1, further comprising the step of applying the modified head related transfer function to the rear signal to generate the modified rear signal.

10. The method as set forth in claim 1, further comprising the step of combining the first copy of the adjusted front signal and the adjusted first copy of the modified rear signal to generate a first channel and combining the adjusted second copy of the front signal and adjusted second copy of modified rear signal to generate a second channel of audio.

11. The method as set forth in claim 7, wherein the step of applying a phase disturbance comprises the step of inverting the phase of one of the first and second copies of the modified rear signal.

12. The method as set forth in claim 1, wherein the step of selectively adjusting volume levels, comprises the steps of proportionally increasing volume levels of copies of the front and modified rear signals according to the relative distance to the intended location of the origination of sounds.

13. The method as set forth in claim 1, further comprising the step of positioning a sound source, wherein the intended location of origins of sounds is determined from the location of the sound source.

14. The method as set forth in claim 13, wherein the sound source corresponds to a object moved on a display by a control device.

15. The method as set forth in claim 1, further comprising the step of applying a 90 degree phase shift relative to the front signal to the rear signal.

16. A system for reproducing sounds having audible directional cues from an input signal, a first copy of the input signal being a front signal and a second copy of the input signal being a rear signal, said system comprising:

input circuitry configured to receive a front signal and a modified rear signal, said modified rear signal generated by applying a modified head related transfer function to the rear signal;

processing circuitry coupled to the input circuitry and configured to associate a first copy of the front signal with a first channel and a second copy of the front signal with a second channel and associate a first copy of the modified rear signal with a first channel and a second copy of the modified rear signal with a second channel; and level adjustment circuitry coupled to the processing circuitry and combination circuitry, said level adjustment circuitry configured to adjust volume levels of the first and second copies of the modified rear signal and the first and second copies of the front signal to provide additional audible directional cues based upon the intended location of origin of sounds.

17. The system as set forth in claim 16, wherein the system is a video game system.

18. The system as set forth in claim 16, wherein the input circuitry comprises a storage access mechanism for accessing the front signal and modified rear signal from a storage device.

19. The system as set forth in claim 18, wherein the storage device is a CD ROM drive.

20. The system as set forth in claim 18, wherein the storage device is nonvolatile memory.

21. The system as set forth in claim 18, wherein the storage device is volatile memory.

22. The system as set forth in claim 16, wherein the modified head related transfer function is the difference between a front head related transfer function and a rear head related transfer function.

23. The system as set forth in claim 22, wherein the modified rear head related transfer function is HRTFrear–HRTFfront, where HRTFrear is a rear head related transfer function and HRTFfront is a front head related transfer function.

24. The system as set forth in claim 23, wherein HRTFfront is a front center head related transfer function.

25. The system as set forth in claim 23, wherein HRTFrear is a left rear head related transfer function.

26. The system as set forth in claim 16, further comprising phase disturbance circuitry coupled to the processing circuitry and level adjustment circuitry and configured to apply a phase disturbance between the first and second copies of the modified rear signal to provide audible direction cues to distinguish sounds originating from the front or rear, wherein the level adjustment circuitry is configured to adjust volume levels of the first and second copies of the phase disturbed rear signal and the first and second copies of the front signal.

27. The system as set forth in claim 26, wherein the phase disturbance comprises at least one time delay added to at least one of the first and second copies of the modified rear signals.

28. The system as set forth in claim 16, further comprising combination circuitry coupled to the level adjustment circuitry to combine the adjusted first copy of the front signal and adjusted first copy of the modified rear signal to generate a first output channel and to combine the adjusted second copy of the front signal and adjusted second copy of the modified rear signal to generate a second output channel.

29. The system as set forth in claim 26, wherein the phase disturbance is generated by inverting the phase of one of the first and second copies of the modified rear signal.

30. The system as set forth in claim 16, wherein the volume adjustment circuitry proportionally increases volume levels of copies of the front and modified rear signals according to the relative distance to the intended location of the origination of sounds.

31. The system as set forth in claim 16, wherein a sound source is a graphic object on a display, and the intended location of origins of sounds is determined from the location of the object.

32. The system as set forth in claim 31, wherein the graphic object is moved on the display by a control device.

33. The system as set forth in claim 16, wherein said rear signal is adjusted by application of a 90 degree phase shift relative to the front signal.

34. A system for reproducing sounds having audible directional cues from an input signal, a first copy of the input signal being a front signal and a second copy of the input signal being a rear signal, said system comprising:

processing circuitry configured to associate a first copy of the front signal with a first channel and a second copy of the front signal with a second channel and associate a first copy of a modified rear signal with a first channel and a second copy of the modified rear signal with a second channel, said modified rear signal being a copy of the rear signal having a modified head related transfer function applied to it, and to adjust volume levels of the first and second copies of the modified rear signal and the first and second copies of the front signal to provide additional directional cues based upon the intended location of origin of sounds.

35. The system as set forth in claim 32, wherein said processing circuitry is further configured to generate the modified rear signal by applying a modified head related transfer function to the rear signal.

36. The system as set forth in claim 34, wherein said processing circuitry is further configured to said processing circuit further configured to add a phase disturbance between the first and second copies of the modified rear signal to provide directional cues to distinguish sounds originating from the front or rear, wherein the processing circuitry is configured to adjust the volume levels of the first and second copies of the phase disturbed rear signal and the first and second copies of the front signal.

37. The system as set forth in claim 36, wherein the phase disturbance is added by inverting the phase of one of the first and second copies of the modified rear signal.

38. The system as set forth in claim 34, wherein said processing circuitry is further configured to apply a 90° phase shift relative to the front signal to the rear signal.

39. The system as set forth in claim 34, wherein said processing circuitry is further configured to combine the adjusted first copy of the front signal and adjusted first copy of the modified rear signal to generate a first channel output, and to combine the adjusted second copy of the front signal and adjusted second copy of the modified rear signal to generate a second channel output.

40. The system as set forth in claim 36, wherein the phase disturbance comprises at least one time delay added to at least one of the first and second copies of the modified rear signal.

* * * * *

UNITED STATES PATENT AND TRADEMARK OFFICE

CERTIFICATE OF CORRECTION

PATENT NO. : 5,798,922

DATED : August 25, 1998

INVENTOR(S) : Wood, et al.

It is certified that error appears in the above-identified patent and that said Letters Patent is hereby corrected as shown below:

In column 4 at line 64 delete "HRTh rear-HRTh" and insert --HRTF rear-HRTF--

In column 4 at line 67 delete "HRTh" and insert --HRTF--

Signed and Sealed this

Third Day of April, 2001

*Attest:*

Nicholas P. Godici

NICHOLAS P. GODICI

*Attesting Officer*

*Acting Director of the United States Patent and Trademark Office*